US005927944A

United States Patent [19]

Belady

[11] Patent Number: 5,927,944

[45] Date of Patent: Jul. 27, 1999

[54] FAN WITH BLADES HAVING INTEGRAL ROTATING VENTURI

[75] Inventor: Christian L. Belady, McKinney, Tex.

[73] Assignee: Hewlett Packard Company, Palo Alto, Calif.

[21] Appl. No.: 08/866,583

[22] Filed: May 30, 1997

[51] Int. Cl.[6] ..... F01D 5/02

[52] U.S. Cl. ..... 415/220; 415/268.2; 416/189

[58] Field of Search ..... 415/211.2, 213.1, 415/208.2, 220, 222, 223; 416/189, 192

[56] References Cited

U.S. PATENT DOCUMENTS

| | | | |
|---|---|---|---|
| 4,358,245 | 11/1982 | Gray | 416/189 |
| 4,548,548 | 10/1985 | Gray, III | 416/189 |
| 5,342,167 | 8/1994 | Rosseau | 415/220 |
| 5,445,215 | 8/1995 | Herbert | 415/115 |
| 5,577,888 | 11/1996 | Capdevila et al. | 415/211.2 |

OTHER PUBLICATIONS

"Propshot" packaging material with instructions printed on the back, showing a fan–like blade having an annular rim surrounding the blades and joined to the blades at the tips thereof. Purchased at Wal–Mart in Colorado on May 29, 1997 by the Agent of Record, E.L. Miller.

*Primary Examiner*—F. Daniel Lopez
*Assistant Examiner*—Richard Woo
*Attorney, Agent, or Firm*—Edward L. Miller

[57] ABSTRACT

A low noise fan reduces the production of turbulent vortices created by the passage of the fan's blade tips through the air by providing an annular venturi that is attached at its inner surface to the blade tips, and that thus rotates with those blades as a unit. This prevents high pressure air at the blade tips from spilling into low pressure air. The outer surface of the rotating venturi may have a close fit against the inner surface of an outer annular stationary housing of the fan, to minimize any acoustic or mechanical mischief created by the otherwise exposed outer surface of the rotating venturi.

4 Claims, 2 Drawing Sheets

FAN WITH BLADES HAVING INTEGRAL ROTATING VENTURI

BACKGROUND OF THE INVENTION

An item of electronic equipment that dissipates more power than can easily be cooled with heat sinks alone generally uses fans to supplement natural convection. This works well enough, but as anyone who has labored in a room full of fan cooled equipment can attest, the noise from the fans themselves can be rather annoying. This is especially so in an office setting, where there arise issues of decorum, in addition to the more pragmatic issues of productivity reduction owing to distractions caused by noise.

A significant amount of fan noise appears to originate with the production of turbulent vortices of air at the tips of the fan blades as they rotate about the fan's axis. The tips pass sideways, as it were, through low pressure air located between the stationary venturi and the moving blade tips. As the blades rotate high pressure air spills over the tips of the blades and imparts an off axis spinning motion in the low pressure air (vortices) whose turbulent behavior results in the production of acoustic energy (noise).

It would be desirable if fan noise could be reduced without sacrificing the air flow the fan is intended to supply.

SUMMARY OF THE INVENTION

A solution to the problem of fan noise is to reduce the production of turbulent vortices created by the passage of the fan's blade tips through the air. This may be done by providing an annular venturi that is attached at its inner surface to the blade tips, and that thus rotates with those blades as a unit. This prevents the spilling over the blade tips of high pressure air into low pressure air. The outer surface of the rotating venturi may have a close fit against the inner surface of an outer annular stationary housing of the fan, to minimize any acoustic or mechanical mischief created by the otherwise exposed outer surface of the rotating venturi.

DESCRIPTION OF THE PREFERRED EMBODIMENT

Figure 1:
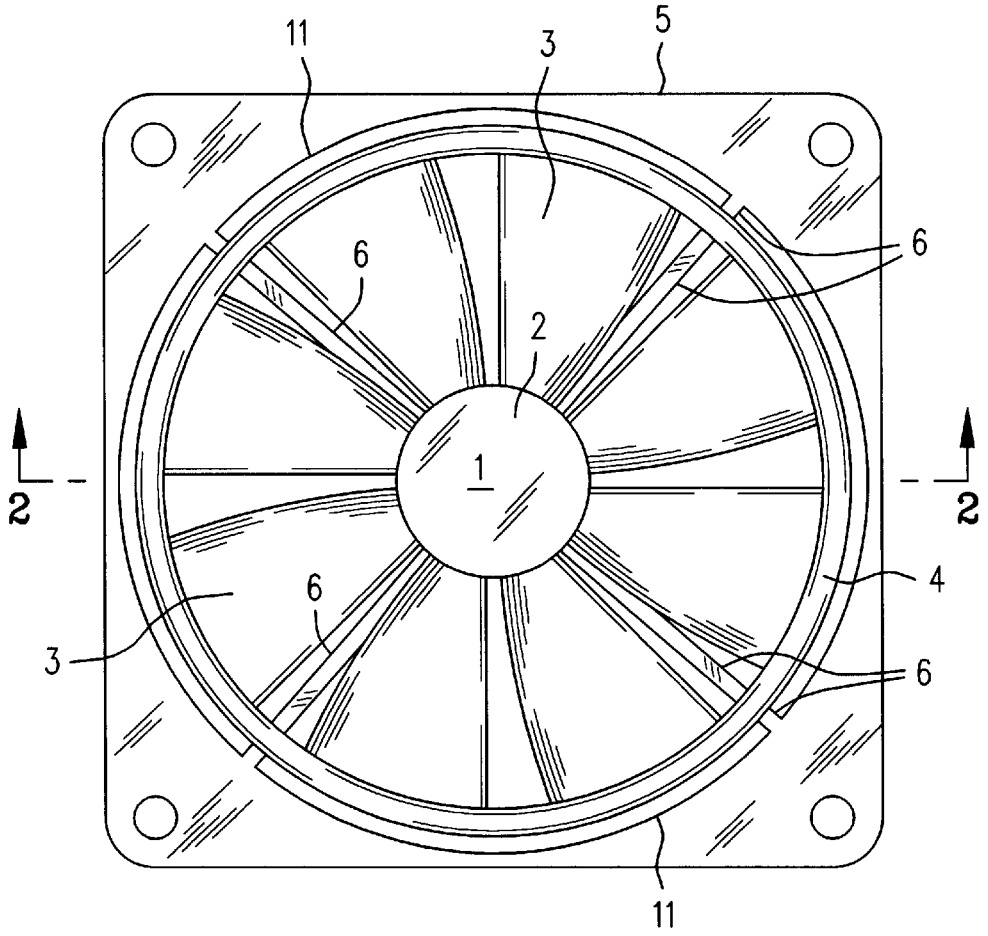
FIG. 1 is a simplified top view of a fan having a rotating venturi attached to the blades of the fan.
Figure 2:
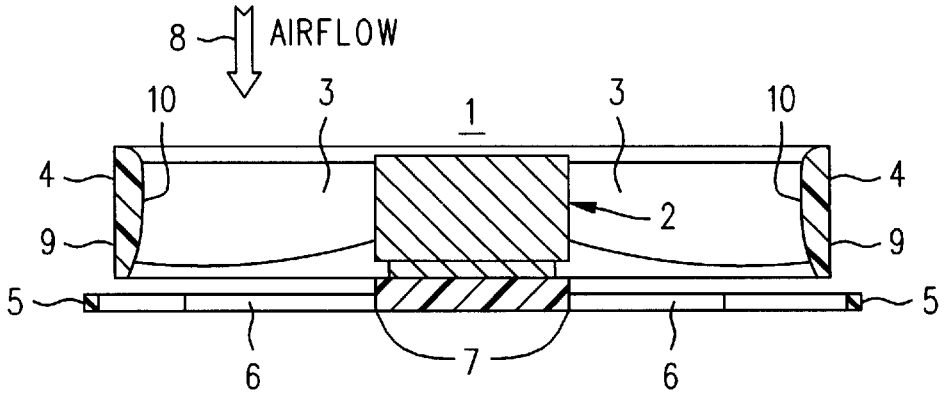
FIG. 2 is a simplified cross sectional view of the fan of FIG. 1.

Refer now to FIGS. 1 and 2, wherein are shown a top view and a cross sectional side view of a fan 1 constructed in accordance with the invention. In particular, a hub 2 is rotatably mounted on a base 5 that includes an open interior region spanned by struts 6. The struts 6 support a central location 7 within the base 5, onto which the hub 2 is mounted. A plurality of blades 3 are attached to the hub 2. A small motor (not shown) under the hub 2 causes the hub and the blades 3 attached thereto to rotate. The direction of airflow is shown by the heavy arrow 8.

An annular venturi 4 is attached to the distal ends of the blades 3, and rotates about the hub as do the blades 3. The annular venturi 4 has an outer surface 9 that may, if desired, be parallel to the axis about which the hub 2 rotates, and has an inner surface 10 that, in a known manner, may resemble an airfoil.

Finally, note that the open interior region (not itself readily depicted) has an outer edge 11. This edge 11 is visible because the diameter of the interior region it represents is slightly larger than the outer diameter of the rotating annular venturi 4. The relative sizes of these diameters is a matter of choice, and it may be desirable for the diameter associated with edge 11 to be greater than the inside diameter of the rotating annular venturi 4 and less than its outer diameter.

Figure 3:
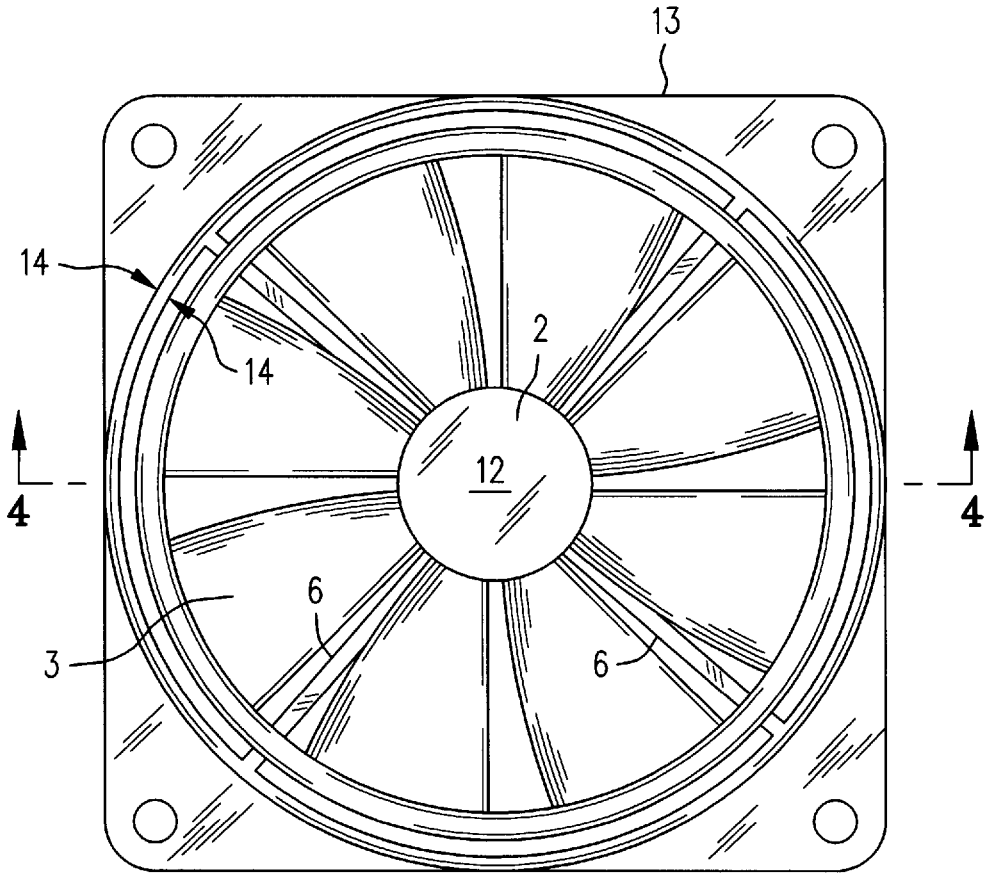
FIG. 3 is a simplified top view of a fan similar to the one in FIG. 1, but having an additional annular housing surrounding the rotating venturi.
Figure 4:
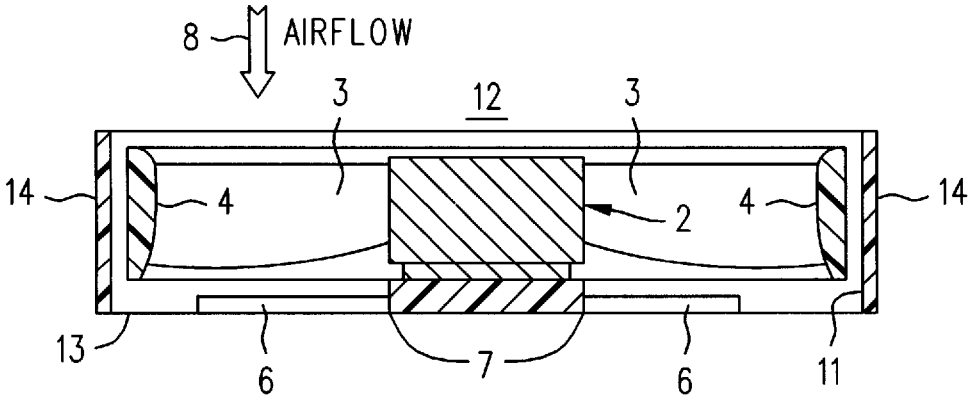
FIG. 4 is a simplified cross sectional view of the fan of FIG. 2.

Now consider the embodiment for fan 12 of FIGS. 3 and 4, where similar or unchanged elements have the same reference characters. Note in FIGS. 3 and 4 the stationary housing, or collar, 14. It is essentially a section of a cylinder that is either simply a molded part of, or is attached to, the base 13. There are many possible reasons for wanting such a housing or collar 14, and they include protecting the rotating annular venturi 4 from inadvertent contact with other objects, acting as a stiffener for the base 13 and serving as a location for mounting a screen.

As before, the exact diameter of the interior region represented by edge 11 is a matter of choice.

The rotating annular venturi 4 of both embodiments described above reduces fan noise by eliminating the vortices created by the passage of the tips of the blades 3 through low pressure air, and by the subsequent spilling of higher pressure air outward in a radial direction into that low pressure air. In the embodiment of FIGS. 3 and 4 it may be desirable to minimize the gap between the outer surface of the rotating annular venturi 4 and the inner surface of the stationary housing or collar 14 to a practical minimum, say, a few hundredths of an inch. A compromise may be necessary between turbulence and drag.

I claim:

1. A fan comprising:

a frame;

a hub rotatably mounted to the frame for rotation about an axis;

a plurality of pitched blades attached at inner ends thereof to the hub and that in a direction toward outer ends thereof project away from the hub; and an annular venturi centered about the hub and having an inlet and an outlet, having an inner surface that generally faces the hub and that at a location proximate the inlet has a diameter less than at the outlet, the annular venturi attached at the inner surface to the outer ends of the plurality of blades, and the annular venturi rotating about the axis of the hub as the hub rotates.

2. A fan as in claim 1 wherein the frame further comprises an open interior region allowing the passage of air therethrough, the interior region is bounded by a peripheral surface from which struts converge toward and meet at a central location within the open interior region, and the hub is rotatably mounted at the central location.

3. A fan as in claim 2 wherein the frame is generally square and has mounting holes near its corners for attaching the fan to a surface.

4. A fan as in claim 2 wherein the frame further comprises a stationary housing disposed about the annular venturi and enclosing an outer surface thereof.

* * * * *